United States Patent [19]

Hess

[11] Patent Number: 5,044,022

[45] Date of Patent: Sep. 3, 1991

[54] SWIMMING POOL COVER

[75] Inventor: Fred Hess, Marbella, Spain

[73] Assignee: Penguin Swimming Pools, Ltd., Chelmsford, England

[21] Appl. No.: 7,978

[22] Filed: Jan. 29, 1987

Related U.S. Application Data

[63] Continuation of Ser. No. 671,182, Nov. 14, 1984, abandoned.

[30] Foreign Application Priority Data

| | | | |
|---|---|---|---|
| Nov. 14, 1983 | [GB] | United Kingdom | 8330287 |
| Feb. 8, 1984 | [GB] | United Kingdom | 8403366 |
| Feb. 24, 1984 | [GB] | United Kingdom | 8404915 |
| Nov. 12, 1984 | [GB] | United Kingdom | 8428500 |

[51] Int. Cl.[5] ..... E04H 4/10

[52] U.S. Cl. ..... 4/502

[58] Field of Search ..... 4/500, 502, 503; 254/202, 203, 327, 338, 394

[56] References Cited

U.S. PATENT DOCUMENTS

| | | | |
|---|---|---|---|
| 2,649,279 | 8/1953 | Jones et al. | 254/338 |
| 2,844,196 | 7/1958 | Jones | 4/502 X |
| 2,958,083 | 11/1960 | Shook et al. | 4/502 |
| 3,979,782 | 9/1976 | Lamb | 4/502 |
| 4,351,072 | 9/1982 | Smith | 4/502 X |
| 4,459,711 | 7/1984 | Sartain et al. | 4/502 |
| 4,560,146 | 12/1985 | Thomas et al. | 254/202 |

*Primary Examiner*—Charles E. Phillips
*Attorney, Agent, or Firm*—John M. Cone

[57] ABSTRACT

A cover for a swimming pool comprises an awning of flexible waterproof sheet material having guide members secured to its longitudinal edges. A pair of side rails are fixed to the longitudinally-extending walls of the pool. The rails are of keyhole cross-section so that the guide members at the edges of the awning can slide into the side rails from their ends and slide longitudinally of the rails to secure the edges of the awning to the walls of the pool along their entire length. A shaft is mounted in a storage box formed adjacent one transverse edge of the pool so that the awning can be rolled around it for storage. Guidelines are attached to the leading edge of the awning and are joined to form a pull-line which runs back to a drum in the storage box. The drum and shaft are driven by means of an electric motor to move the awning along the pool.

14 Claims, 7 Drawing Sheets

FIG. 8
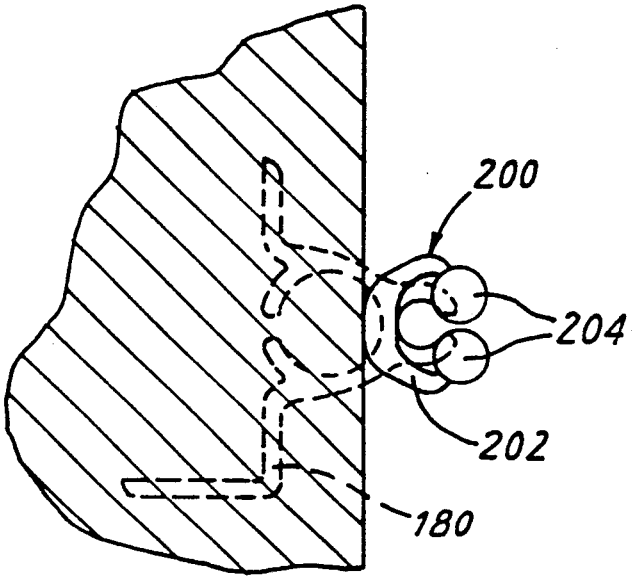
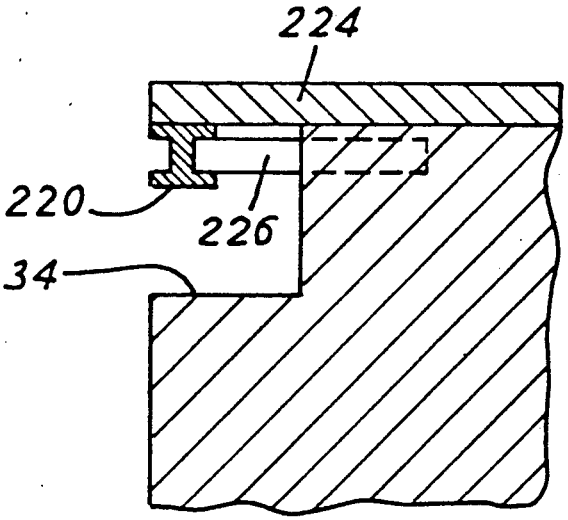
FIG. 9

SWIMMING POOL COVER

This application is a continuation of application Ser. No. 671,182, filed Nov. 14, 1984, now abandoned.

TECHNICAL FIELD

The present invention relates to covers for outdoor swimming pools.

BRIEF DESCRIPTION OF THE INVENTION

In a first aspect the invention provides a cover for a swimming pool, the cover comprising:

an awning of flexible sheet material;

a pair of side rails of keyhole cross-section;

means for mounting said side rails along opposite sides of said pool;

guide members secured to opposite longitudinal edges of said awning and shaped to enter the side rails from their ends and to slide longitudinally thereof; and a pair of pull lines secured to a transverse edge of said awning at opposite sides thereof by means of which pull lines said awning can be drawn over said pool with said guide members sliding in said side rails; said pull lines being joined to form a single pull line whereby tension applied to said single line to move said awning is transmitted substantially evenly to the two sides of said awning.

In a further aspect, the invention provides a swimming pool, a cover comprising:

an awning of flexible sheet material;

at least one pull line secured to a forward transverse edge of said awning, by means of which pull line said awning can be drawn in a longitudinal direction over said pool; and a substantially rigid support member secured to and extending across said forward transverse edge of said awning; a forward surface of said support member being provided with a decorative finish to match the decorative finish of the interior of said pool.

In a further aspect, the invention comprises a cover for a swimming pool, the cover comprising:

an awning of flexible sheet material;

at least one pull line secured to a transverse leading edge of said awning by means of which pull line said awning can be drawn in a longitudinal direction over said pool;

a rotary shaft, mounted adjacent one transverse edge of the pool, to which the trailing edge of said awning is secured, said shaft being rotatable to roll said awning thereon for storage;

a rotary drum, mounted at the same end of the pool as said rotary shaft, to which the free end of said pull line is secured whereby said drum is rotatable to wind said line onto it to draw said awning over said pool;

a bidirectional electric motor; and clutch means operable selectively to couple said rotary drum and said rotary shaft to said motor.

In a still further aspect, the invention provides a cover for a swimming pool, the cover comprising:

an awning of flexible sheet material;

means for extending said awning over said pool; and a drainage channel; the uppermost surface of said awning when extended over said pool communicating with said drainage channel whereby water collecting on said uppermost surface can drain away.

DESCRIPTION OF THE DRAWINGS

FIG. 8 shows the cover feeder of the cover of FIG. 1;

FIG. 9 is a fragmentary sectional view showing a part of the pool wall.

DETAILED DESCRIPTION OF PREFERRED EMBODIMENT

Figure 1:
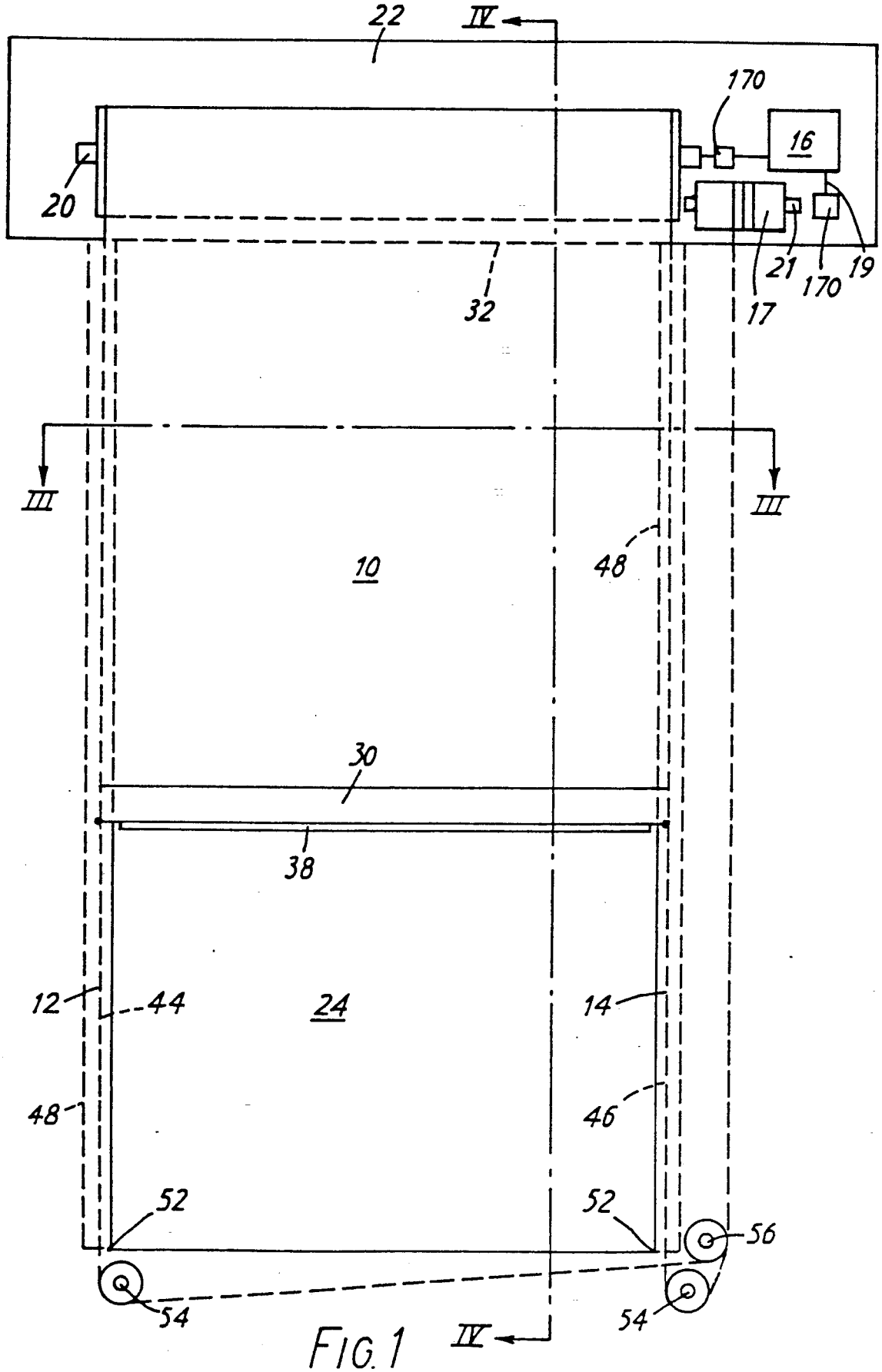
FIG. 1 is a schematic plan view of a swimming pool cover in accordance with the invention.
Figure 2:
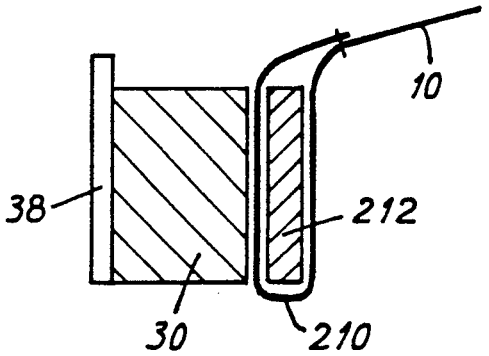
FIG. 2 is a fragmentary sectional view showing the leading edge of the cover of FIG. 1.

The swimming pool cover shown in the drawings comprises a soft fabric cover or awning 10, which is operated by means of guidelines 12 and 14 and an electric motor 16.

When it is out of use, the cover 10 is rolled onto a shaft 20 and is concealed in a storage box 22 formed at one end of the pool 24. The storage box 22 is simply a rectangular-section trough moulded into the concrete forming the end wall 32 of the pool 24. The trough is closed by one or more traps 26 which can be removed to give access to the interior of the box 22 but which normally serve to keep the box interior dry. The storage box 22 communicates with the inside of the pool 24 by means of a narrow slot 28 positioned above the waterline and extending the entire width of the pool.

The cover 10 is made of any suitable waterproof fabric, for example, canvas or Dacron and may be made either from a single piece or from a number of pieces joined together. The pieces are joined so as to form waterproof seams, for example by welding. The fabric of the cover 10 may be treated with ultra-violet resistant PVC to protect it against deterioration through exposure to bright sunlight.

The leading edge of the cover 10 extends from the roll through the slot 28 and is secured to an aluminium bar 30 which extends the entire width of the pool 24 and prevents the cover 10 sagging into the pool 24. The cover 10 is secured to the bar 80 by means of a transversely extending pocket 210 formed at its leading edge in which is located a relatively thin aluminium bar 212. The bar 212 is butted up to the rear face of the front bar 30 so that a part of the cover 10 forming the pocket 210 is trapped between the two bars 212 and 30. The two bars 212 and 30 are then fastened together by passing screws through the bar 212 into the front bar 30 at intervals.

The end wall 32 of the pool 24 adjacent the slot 28 is recessed so that it forms a transversely-extending ledge 34 on which the bar 30 rests when the cover 10 is out of use. The rear surface of the bar which abuts the pool wall 32 may be provided with a rubber or elastomeric gasket (not shown) which forms a seal around the slot 28 to prevent water being splashed through the slot 28 into the storage box 22. The front face of the bar 30 is finished in the same manner as the inside of the pool, for example, by means of decorative tiling 38, so that when the cover 10 is fully withdrawn, the front of the bar 30 merges with the rest of the wall 32 so as to make the cover 10 as unobtrusive as possible.

Alternatively, the rigid bar may be of T-shaped cross-section; the "T" in use being oriented horizontally so that the edge of the cover 10 is secured to the upright of the T while the cross-piece is provided with a decorative finish to match the pool interior.

Figure 3:
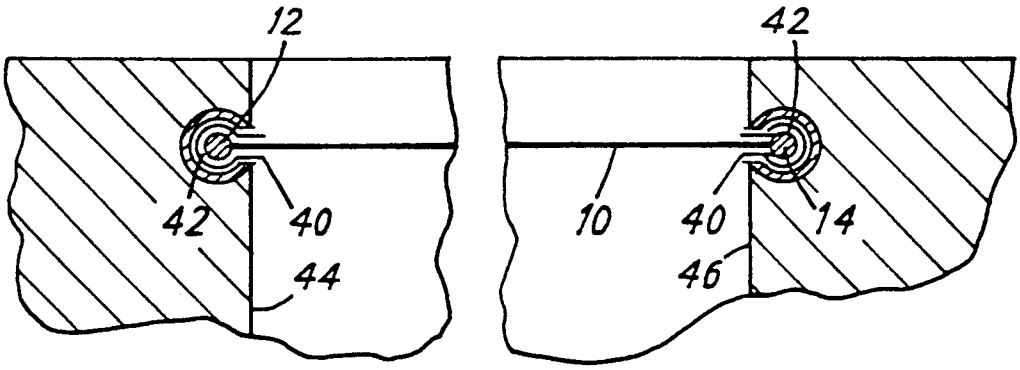
FIG. 3 is an enlarged vertical section taken on the line III—III of FIG. 1.
Figure 4:
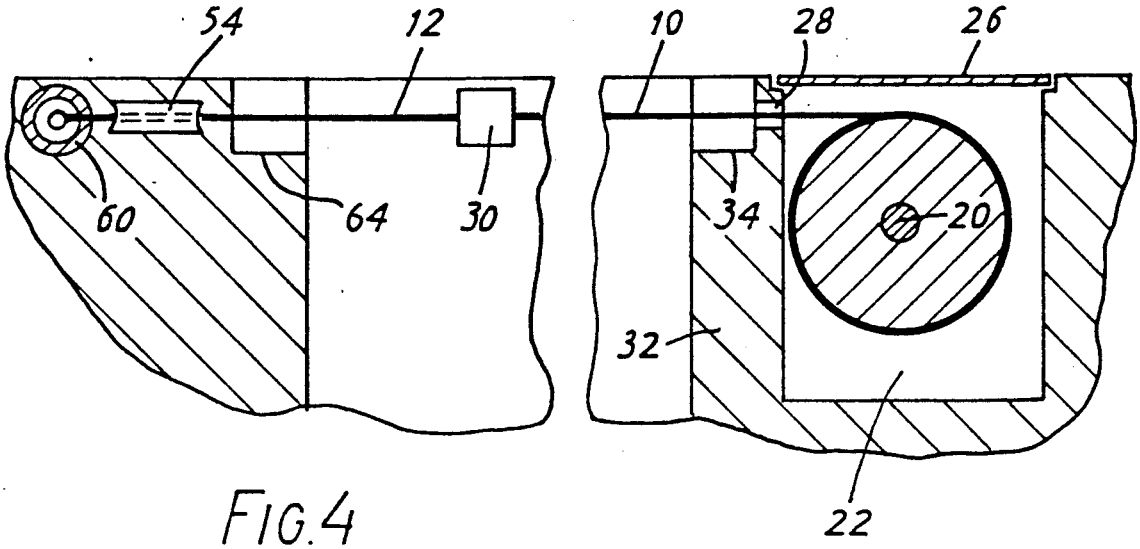
FIG. 4 is an enlarged vertical section taken on the line IV—IV of FIG. 1.

The side edges of the cover 10 are secured to the guide lines 12 and 14 by means of tape 40 which is sewn to the edges of the cover 10 so as to form channels 42 through which the guide lines 12 and 14 extend as shown in FIG. 3. The guidelines 12 and 14 are of pre-stretched line, for example, 6 mm diameter Kevlar having the same stretch characteristics as wire rope.

Set into the side walls 44 and 46 of the pool 24, at the same level as the slot 28, are side rails 48 which are formed of extruded aluminium having a keyhole type cross-section. That is, the rails 48 are generally tubular and are formed with a longitudinally-extending slot 50 which opens towards the interior of the pool.

One preferred form of extruded rail 48 is shown in FIGS. 5 to 8.

The extruded section of FIGS. 5 to 8 consists of two generally cylindrical passages 182 and 184 having a common wall 183 which separates them. Extending along the wall of each passage 182 or 184 at the side remote from the common wall 183 is a longitudinal slot 185 or 186. In the case of the passage 182, the slot 185 gives the passage a keyhole shape which permits the edge of the awning 10 to slide along the side rail; in use one of the guide lines 12 or 14 enclosed in its tape loop is located in the passage 182 with the margin of the awning 10 extending through the slot 185.

The edges of the slot 185 are slightly depressed towards the inside of the passage 182 so as to provide a flatter, smoother external appearance when mounted in or on the pool wall.

The slot 186 in the wall of the other passage 184 is simply to permit the rail 48 to be manufactured by extrusion rather than by more costly injection moulding processes.

Extending from the wall of the passage 184 at its side remote from the other passage 182 are two flanges 188 which are shaped to define together a planar surface 189 which may, when the rail 48 is mounted, bear against the flat surface of a wall to which the rail is secured. One of the flanges 186 is extended and bent through a right angle to form a second flange 190 perpendicular to the plane of the surface 189.

Figure 5:
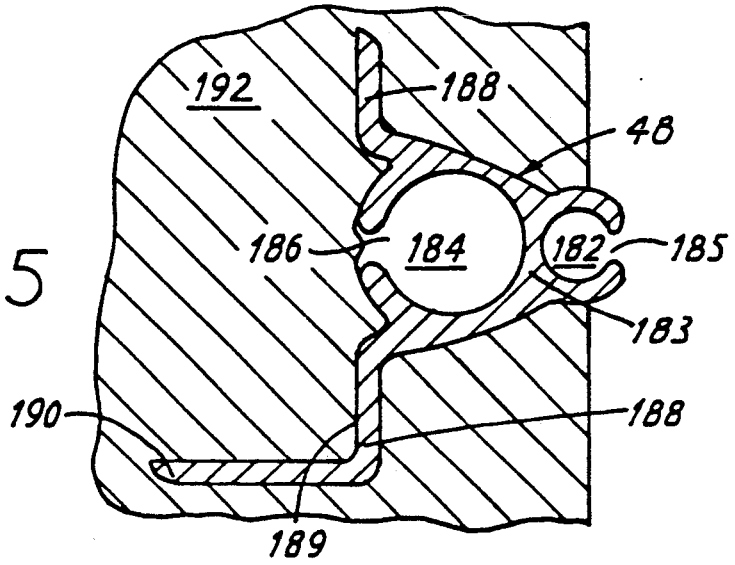
FIGS. 5 to 7 are schematic sectional views of a side rail forming part of the pool cover of FIG. 1.
Figure 6:
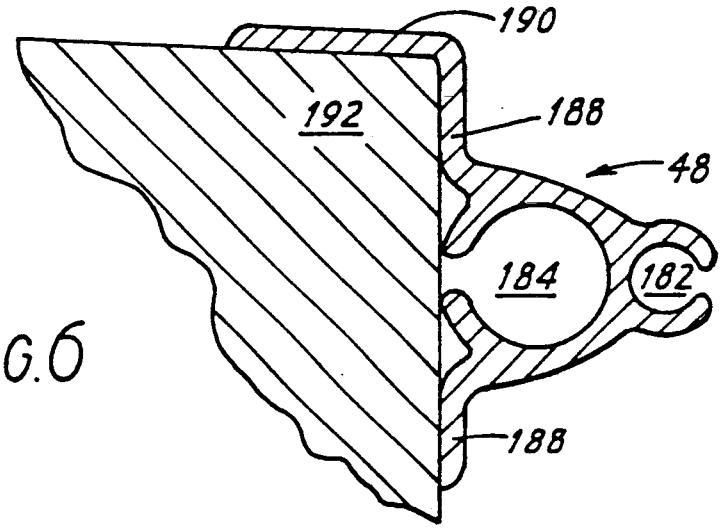

This configuration is particularly versatile and advantageous in that it can be fitted both to pools under construction and in existing pools.

Where the cover is to be fitted to a pool during construction, the side rail extrusion is oriented so that the flange 190 is at the lower edge of the rail and extends horizontally away from the interior of the pool, as shown in FIG. 5. The flanges 188 and 190 thus serve to key the rail to the concrete 192 of the pool wall.

Where the rails 48 are to be fitted to an existing pool, the edges of whose walls are sufficiently rectangular, the extruded section is simply inverted and mounted so that the flange 190 overlies the edge of the horizontal surface around the pool and the surfaces 189 of the flanges 188 abut the upper margin of the vertical pool wall, as shown in FIG. 6. The flanges 188 and 190 are then bolted to the pool wall or secured by any other suitable means.

Figure 7:
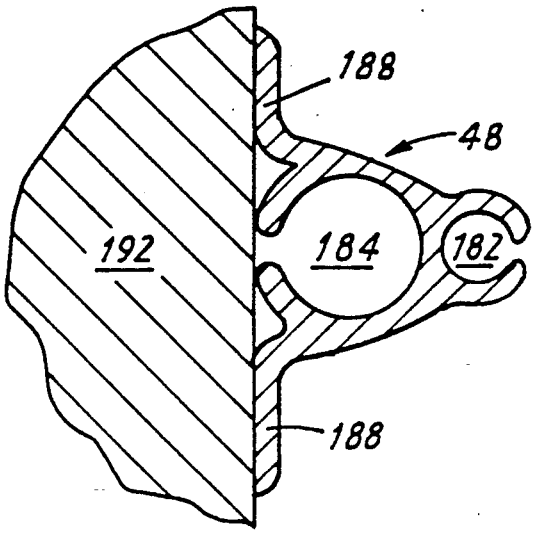

Alternatively, if the edges of an existing pool are not sufficiently square to permit the rail to be mounted in this way, the flange 190 may be cut away from the extruded section so that the rail can be bolted to the vertical pool wall, as shown in FIG. 7.

As the side rail 48 may, in some circumstances, be mounted externally of the pool wall, the extruded sections are formed with rounded edges, so that, once mounted, the rails have a smooth outer surface. Also, the extruded sections may be provided with a coloured or otherwise decorative finish so that the mounted side rails present a neat and pleasing appearance.

Aluminium sections are normally manufactured in relatively short lengths and it is, therefore, necessary to join several lengths together to form a side rail extending the entire length of a typical pool.

This is achieved by inserting a length of plastics tubing (not shown) along the passages 184 of the extruded sections. Preferably, the external diameter of the plastics tubing used is only very slightly less than the internal diameter of the passage 184 so that the tubing serves to align the extruded sections. The tubing is fixed to the sections by, for example, glueing.

If the cover is to be fitted to a pool which does not have a pair of parallel side walls, for example, a kidney-shaped pool, the side rails, which must, of course, be parallel to one another, may be mounted on the ground surface close to the edges of the pool.

The margins of the cover 10 pass through the keyhole slots 185 of the side rails 48 but the guide lines 12 and 14 are of diameter such that they cannot pass through the slots but must enter the rails 48 through the openings at their ends. Consequently, the guide lines 12 and 14 serve to retain the edges of the cover 10 in the side rails 48, thus anchoring the edges of the cover 10 to the walls of the pool 24.

To ensure that the cover 10 is properly aligned as it enters the side rails 48 and to prevent jamming which could damage the cover, a feeder 200 is mounted on the pool wall close to the inlet end of each side rail 48. The feeder 200, which is shown in FIG. 8 of the drawings, consists of a generally C-shaped bracket 202 which is secured to the wall of the pool in any convenient manner and two balls 204 rotatably mounted on the ends of the arms of the braket 202. The balls 204 are positioned so that there is a small gap between them.

The guide line 12 or 14 attached to the edge of the cover 10 passes through the central opening of the feeder 200 between the bracket 202 and the balls 204 with the margin of the cover 10 extending through the gap between the balls 204. The feeder 200 thus supports the edge of the cover in the position in which it must enter the side rail 48 but allows the cover 10 to pass freely through it with the balls 204 rolling over the cover surface.

The guide lines 12 and 14 extend along the entire length of the pool 24 to the corners 52 of the pool remote from the storage box 22. At the end of the pool remote from the storage box 22, each line 12 and 14 passes around a pulley wheel 54 mounted at the corner 52 of the pool 24. The line 12 at the side of the cover 10 farthest from the motor 16 is drawn across the end of the pool 24 and then, with the line 14, passes around a double turning block 56. The two guide lines 12 and 14 are then spliced together to form a single return line 13. The return line 13 extends from the far end of the pool 24 back to the storage box 22. The portion of the guide-line 12 extending across the end of the pool 24 may run through a concealed passage in the pool wall formed by embedding a length of polypropylene piping 60 in the concrete forming the wall. The return line 13 conveniently runs back to the storage box 22 through the conduit defined by the plastics tubing linking the passages 184 of the side rail extrustions.

Mounted within the storage box 22 is an electric motor 16. An idler drum 17 is coupled to the motor 16 by means of a conventional chain drive 19 and mounted for rotation with a further shaft 21 parallel to the roller shaft 20. The end of the pull-line 13 is secured to the idler drum 17.

The electric motor 16 is also coupled to the roller shaft 20 by means of a chain drive. In each case, the sprocket wheel of the chain drive carried by each shaft 20 or 21 is mounted by means of a clutch 170 which can be disengaged, for example, by means of a solenoid, to allow the sprocket wheel to rotate freely relative to the shaft 20 or 21. To extend the cover 110 over the pool, the clutch 170 on the roller shaft 20 is disengaged and the motor 16 is operated to rotate the drum 17 so as to wind up the line 13 and draw the cover 10 over the pool. To withdraw the cover, the clutch 70 on the roller shaft 20 engaged and that on the drum shaft 21 disengaged. The motor 16 can then be operated to drive the shaft 20 so as to roll the cover 10 onto the shaft while the drum 17 rotates freely to allow the line 13 to unwind.

The use of a single return line 13 ensures that the pull on the line is transmitted evenly to the two guide lines 12 and 14 and thus avoids the possibility that the cover 10 may skew and eventually jam which could arise if two separate return lines were used.

Figure 10:
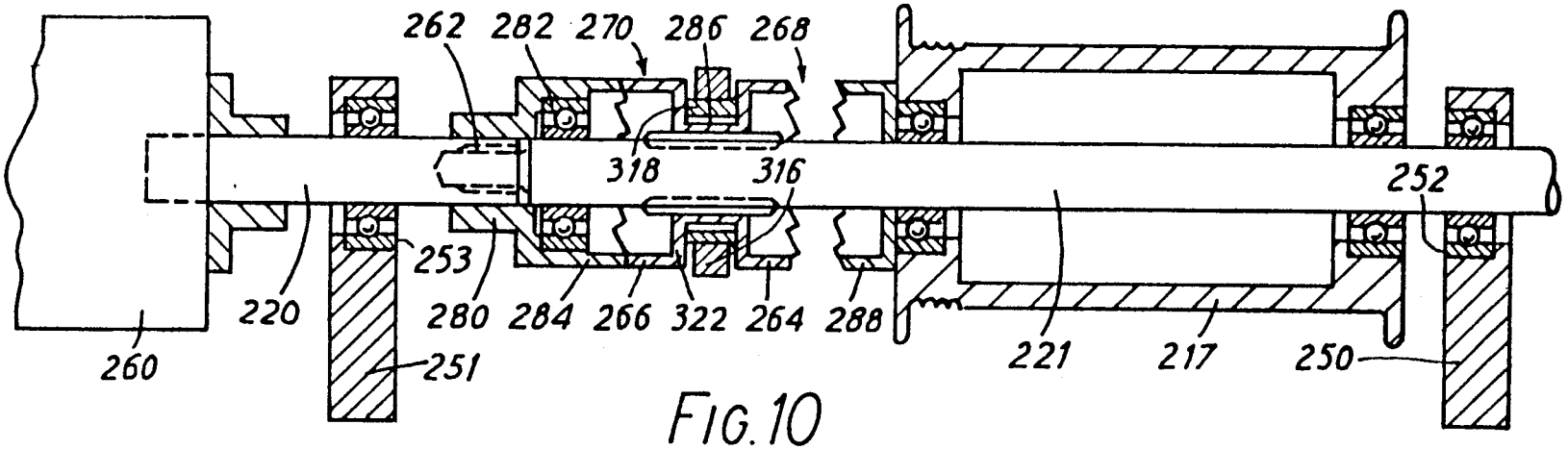
FIGS. 10 and 11 are schematic sectional side views through two drive arrangements for use with the swimming pool cover of FIG. 1.
Figure 11:
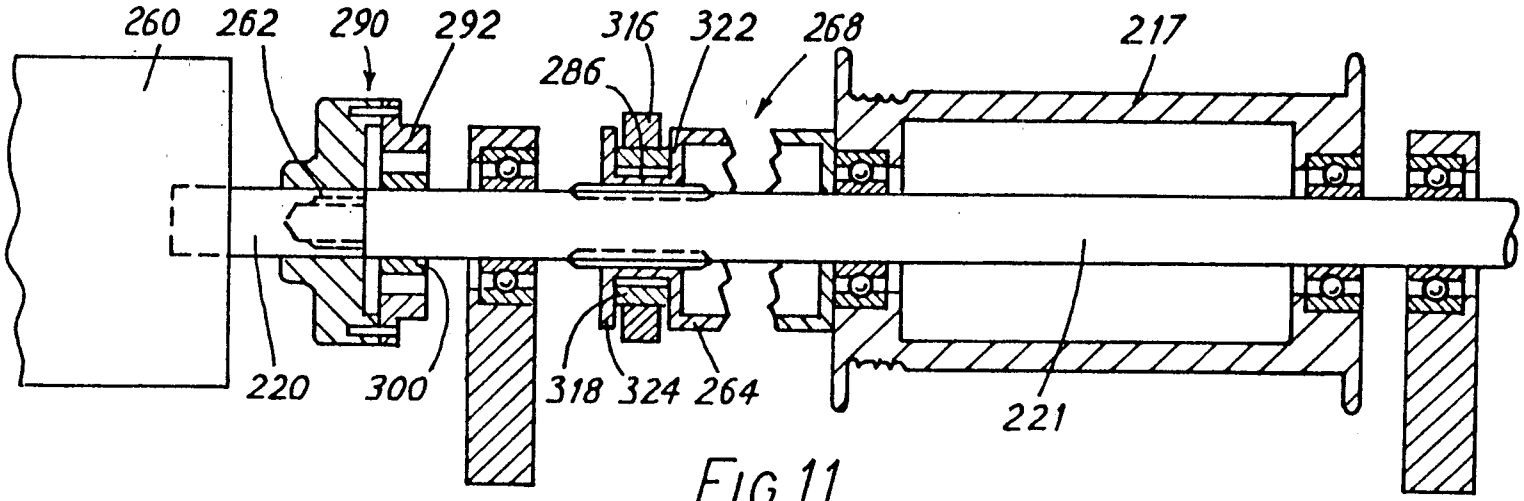

Two alternative forms of drive arrangement for the cover are shown in FIGS. 10 and 11 of the drawings.

In FIG. 10, the cable drum 217 is mounted on a rotary shaft 221 and the roller 260, onto which the cover 10 is wound when out of use, is mounted on a second shaft 220 which is coaxial with the shaft 221. The shaft 220 is supported at either end of the roller 260 by means of roller bearings 253 in trunnions 251, only one of which is shown in the drawing. The shaft 221 is also supported at its end remote from the roller 260 by means of a roller bearing 252 in a trunnion 250 but its end closest to the roller 260 is supported by engagement with the shaft 220 through a needle bearing 262 which permits the two shafts 220 and 221 to rotate freely relative to one another.

The roller 260 is keyed onto the shaft 220 so that it rotates with it. The end of the shaft 220 carries a collar 280 which extends longitudinally of the shaft to surround the end portion of the shaft 221. The collar 280 is keyed to the shaft 220 but engages the shaft 221 via a roller bearing 282 so that it can rotate freely relative to the shaft 221. At its end remote from the roller 260, the collar 280 is shaped to form a clutch plate 284 which is one half of a dog clutch 270. The second clutch plate 266 of the clutch 270 is carried by a sleeve 286 which is mounted for rotation on the shaft 221 but which is axially slidable relative thereto. Thus, when the clutch plates 284 and 266 of the clutch 270 are brought into engagement, as shown in FIG. 11, the shaft 220 and, hence, the roller 260 are caused to rotate with the shaft 221.

The collar 280 is shaped, at its end adjacent the cable drum 217, to define a further clutch plate 264 forming one half of a second dog clutch 268. The other plate 288 of the clutch 268 is fixed to the end surface of the cable drum 217 which is mounted on the shaft 221 by means of roller bearings 290. Consequently, the cable drum 217 is only caused to rotate with the shaft 221 when the clutch 268 is engaged.

To extend the cover 10 over the pool, the sleeve 286 is moved to the right as seen in FIG. 10 so as to engage the cable drum clutch 268 and disengage the roller clutch 270. Then, when the shaft 221 is driven by means of an electric motor (not shown) the drum 217 rotates with the shaft 221 so as to wind in the line 13. At the same time, because the clutch 270 is disengaged, the roller 260 and its shaft 220 can rotate relative to the driven shaft 221, allowing the roller 260 to freewheel under the tension of the cover 10. Conversely, to withdraw the cover 10 into the storage box, the sleeve 286 is moved along the shaft 221 so as to engage the roller clutch 270 and disengage the cable drum clutch 268. Thus when the shaft 221 is driven, the shaft 220 and roller 260 rotate to wind in the cover 10 while the cable drum 217 freewheels under the tension in the line 13. By suitably arranging both the cover 10 and return line 13 so that they pass either under or over the roller 260 or cable drum 217, respectively, the drive arrangement of FIG. 11 may be used with either a one-directional or a bidirectional electric motor.

FIG. 11 shows a drive arrangement which is similar in principle to that of FIG. 10 except that instead of employing two dog clutches, it utilizes a single dog clutch 268 to engage the cable drum 217; a sprag clutch 290 being used to engage the roller 260.

As in FIG. 10, the roller 260 is mounted for rotation with a shaft 220 and the cable drum 217 is mounted via roller bearings on a shaft 221. The two shafts 220 and 221 are coaxial and rotatable relative to one another, engaging each other through a needle bearing 262. The construction of the dog clutch 268 is the same as that of FIG. 10 except that the axially-slidable sleeve 286 is modified to carry only a single clutch plate 264.

Figure 14:
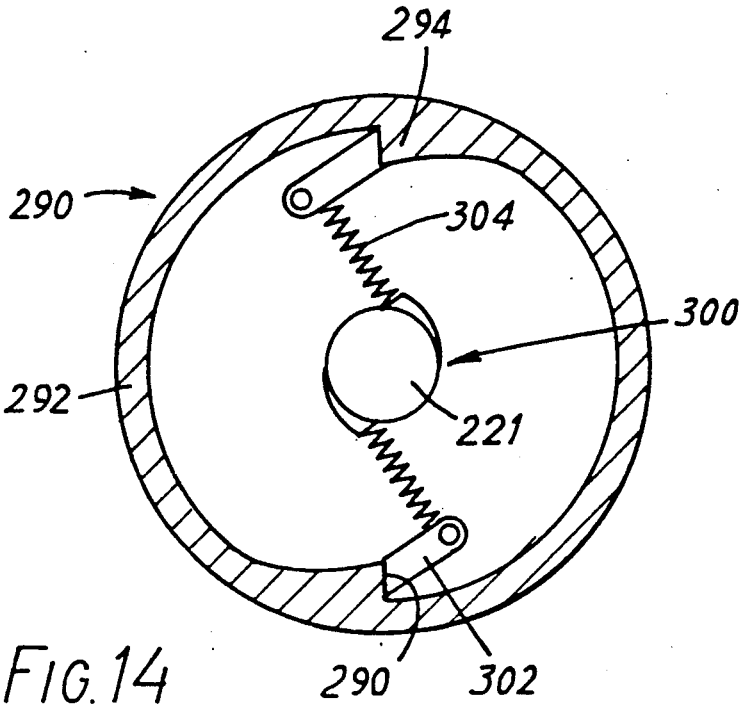
FIG. 14 is a schematic sectional view of the sprag clutch of the drive arrangment of FIG. 11.

The shaft 220 and roller 260 can be caused to rotate with the driven shaft 221 by the operation of a sprag clutch 290, the construction of which is shown in FIG. 14.

The sprag clutch 290 comprises an outer cylindrical casing 292 formed with two diametrically-opposed, inwardly extending projections 294. Each of the projections 294 is generally triangular in cross-section having a radial end face 296 and tapering from the end face 296 to the wall of the casing 292. The casing 292 is mounted for rotation with the shaft 220 by means of a collar 298 keyed to the shaft 220 to which it is bolted. When mounted the casing 292 overlies a portion of the shaft 221.

The clutch 290 also includes a central unit 300 which is mounted on the shaft 221 so as to rotate therewith. As shown in FIG. 14, the central unit 300 is provided with two diametrically opposed, pivotally-mounted arms 302 which are biassed outwards by means of springs 304.

The arms 302 and projections 294 cooperate in a ratchet-like manner. When the shaft 221 is driven in an anti-clockwise direction as seen in FIG. 14, the arms 302 ride over the projections 296 so that the central unit 300 and casing 292 rotate relative to one another. However, if the shaft 221 is rotated in a clockwise direction, as seen in FIG. 14, the arms 302 engage with the end faces 296 of the projections 294 and the casing 292 is caused to rotate with the shaft 221.

To extend the cover 10, the clutch 268 is engaged and the shaft 221 driven in an anti-clockwise direction as seen in FIG. 14. The cable drum 217 rotates with shaft 221 to wind in the return line 13 and the arms 302 of the sprag clutch 290 ride over the projections 294 to allow the casing 292 and, hence, the roller 260 to freewheel under the tension in the cover 10. If a sprag clutch is used in this way, it is, however, essential that the roller 260 is of larger diameter than the cable drum 217. This ensures that the roller 260 always rotates no faster than the central unit 300 of the clutch 290. If this were not the case, the arms 302 might tend to engage the projections 294 so as to brake the movement of the shaft 221.

To withdraw the cover 10, the clutch 268 is disengaged and the shaft 221 driven in a clockwise direction as seen in FIG. 14. This causes the casing 290 and, thus, the roller 260 to rotate to wind in the cover while the cable drum 217 freewheels under the tension in the return line 13.

It will be appreciated that a sprag clutch can only be used where the shaft 221 is to be driven by means of a bidirectional motor. It will also be appreciated that it is possible to replace the dog and sprag clutches described above with any other suitable form of clutch, for example, electro-magnetic clutches.

The clutches of the drive arrangements shown in FIGS. 10 and 11 may be engaged and disengaged either manually or in any other convenient manner. One particularly convenient mechanism is shown in FIGS. 12 and 13 of the drawings.

The sleeve 286 which carries the moving clutch plate or plates, is moved axially along the shaft 221 by means of a solenoid-operated lever 310. The lever 310 is coupled at one of its ends by means of a suitable linkage 312 to a solenoid actuator 314 and its other end is shaped to form a curved U-shaped fork or yoke 316. The ends of the yoke 316 are directed inwards, towards one another and each is provided with a roller 318 mounted for rotation about an axis extending transversely of the lever arm 310. The lever 310 is mounted to be pivotable about a fixed point 320 intermediate its ends.

In use, the rollers 318 locate in grooves or channels 322 formed in the sleeve 286. In FIG. 10, the channel 322 is defined by the rear surfaces of the clutch plates 264 and 266 and, in FIG. 11, the channel 322 is defined by the rear of the clutch plate 264 and an outwardly-extending flange 324 specially provided on the sleeve 286.

Figure 12:
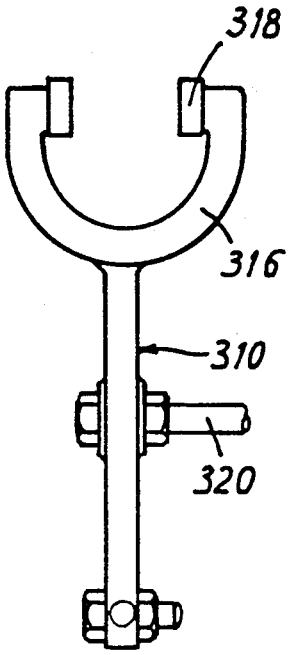
FIGS. 12 and 13 are a side view and a plan view respectively of the operating lever of the drive arrangements of FIGS. 10 and 11.
Figure 13:
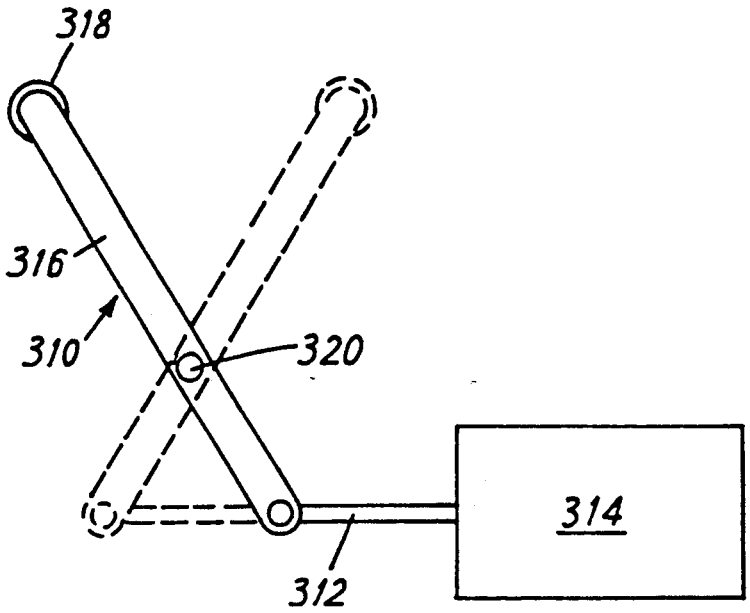

The solenoid actuator 314 is operable to cause the lever 310 to pivot about the fixed axis 320 between the extreme positions indicated in solid and dotted lines, respectively, in FIG. 12. The engagement of the rollers 318 in the channels 322 formed in the sliding sleeve 286 causes the sleeve 286 to move axially of the shaft 221 to engage and disengage the clutches 268 and 270. Furthermore, the rollers 318 are able to move longitudinally of the channels 322 and, thus, transversely of the shaft 221 to accommodate the curved path of the lever yoke 316 as it pivots about the fixed axis 320.

Once the cover 10 is in place over the pool 24, it is held in this position by the guide lines 12 and 14, which remain taut, and by the engagement of the guide lines 12 and 14 in the side rails 48. In this position, the cover 10 is capable of supporting an almost unlimited weight when the pool is full and at least the weight of several adults when the pool is empty.

At either end of the pool, ledges 34 and 64 are provided to support the front bar 30 when the cover 10 is in the two extreme positions. At the end of the pool remote from the storage box 22 it has been found that it is advantageous to provide a latching arrangement, for example, a solenoid-operated latch, midway across the pool to engage the central part of the front bar 30. This prevents the bar 30 from flexing so that water from the pool is forced onto the top of the cover when the cover is supporting a load.

Electrical connections to the latch or to any of the electrical equipment in the storage box 22 may conveniently be made by passing cables, enclosed in plastics tubing of small diameter, through the passages 184 of the side rail extrusions.

In order that the pool should present a neat appearance when the cover 10 has been fitted, it is desirable that the ledges 34 and 64 should lie directly beneath the coping stones or tiles used to finish the pool surround so that they are concealed when viewed from most angles. However, the tiles or coping stones typically used for finishing pool surrounds are such that, if they are fixed only along their rear edge so that they extend over the ledges 34 and 64, they tend to become detached due to their own weight and drop into the pool.

In order to produce a neat finish to conceal the ledges 34 and 64 it is, therfore, necessary to provide a support for the coping stones or tiles. This can be achieved by building a bridge extending transversely across the pool above the ledges 34 and 64 to support the forward portions of the coping stones or tiles as shown in FIG. 9. The bridge may, for example, be formed by one or more I-section girders or beams 230 extending the full width of the pool. To prevent the bridge itself flexing and dislodging tiles or coping stones 224, one or more cantilever supports 226 for the bridge may be provided across the width of the pool. The supports 226 consist of short beams secured at one end to the I-beams 230 and having their other ends embedded in the pool surround.

If the cover is to be fitted to an existing pool, difficulties arise in providing a suitable ledge for the front bar 30 of the cover 10 at the end of the pool remote from the storage box 22 without at least partially destroying and rebuilding the end wall of the pool. Similarly, the wall must be adapted to house the pulleys 54 and to provide a conduit for the passage of the portion of the guide line 12 which extends across the end of the pool.

Figure 15:
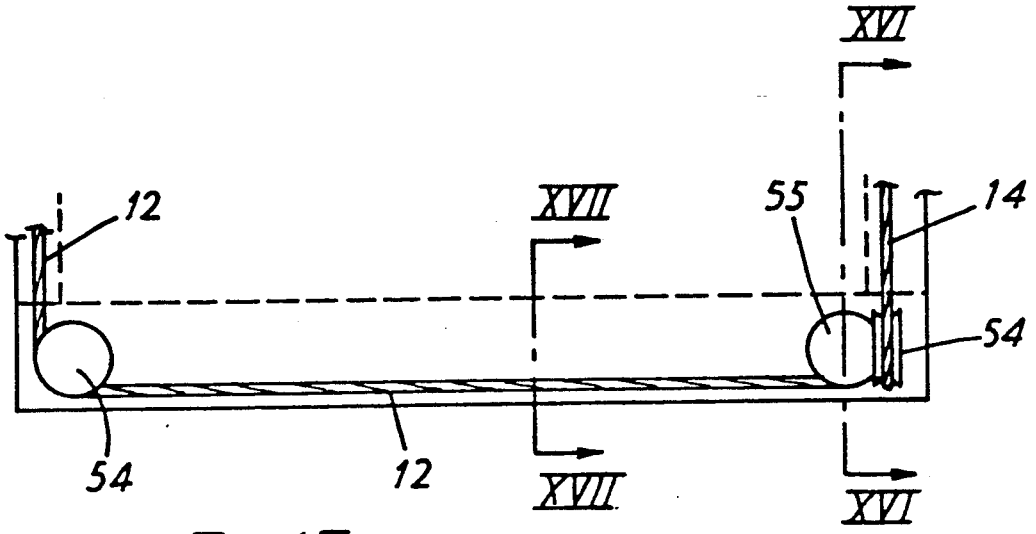
FIG. 15 is a fragmentary plan view of a part of a modified pool cover in accordance with the invention.
Figure 16:
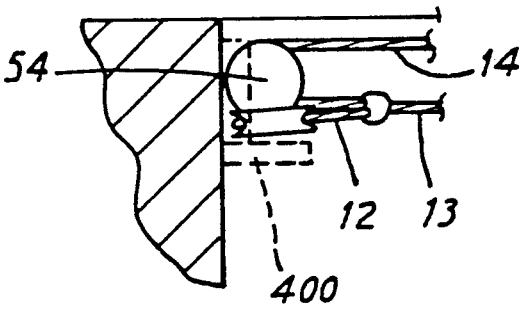
FIG. 16 is a section on line XVI—XVI of FIG. 15.
Figure 17:
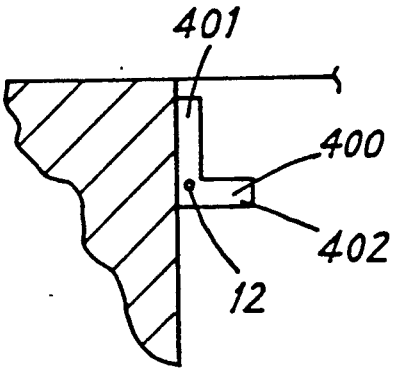
FIG. 17 is a section on line XVII—XVII of FIG. 15.

The need to rebuild parts of the end wall can be avoided by use of the bracket arrangement shown in FIGS. 15 to 17.

An L-shaped bracket 400 is bolted to the end wall with its vertical arm 401 abutting the wall surface. The horizontal arm 402 of the "L" forms a ledge on which the front bar 30 of the cover 10 may conveniently be rested. At either end, the bracket 400 carries a pulley 54 around which the guide lines 12 and 14 pass. The axes of the two pulleys 54 are perpendicular to one another; the axis of the pulley around which the guide line 12 passes is generally vertical whilst that of the pulley 54 around which guide line 14 extends is roughly horizontal. The guide line 12 passes around a further pulley 55 before being joined to the guide line 14 to form the single return line 13.

The bracket 400 is conveniently of a hollow tubular configuration so that it provides a conduit to guide the guide line 12 as it extends across the width of the pool. Such a bracket 400 may also house cables carrying current to the solenoid-operated latch described above or to proximity or limit switches located at the ledge 64 to cause the power supply to the electric motor 16 to be switched off automatically when the cover 10 is fully extended.

Because the cover described above extends from end to end of the pool when in place, and into the side walls of the pool, they form an almost complete seal with the pool walls to prevent the entry of dirt and leaves into the pool. After a heavy rainfall, dirty rain-water collects on the surface of the cover until it reaches the level of the slot 28. Once it reaches this level, it drains into the storage box 22. Consequently, the storage box 22 is preferably made self-draining. For example, the box may drain into the waste pipe from the pool through a one-way ball-valve. As water collecting on the cover drains away in this manner, the covered pool can be left unsupervised during periods of bad weather without any risk that the area around the pool will be flooded. Any dirty water which remains on the cover when the pool is again required for use can be removed using the pool pump vacuum hose to prevent it running into the clean pool water.

Furthermore, if the cover is made of a suitable thermally-insulating material, it can also be used to reduce heat loss from the pool, and, thus, considerably decrease heating costs.

Swimming pools always constitute a safety hazard, particularly insofar as children are concerned, but because the cover is capable of supporting the weight of several people even when the pool is full, the cover can be used as a large waterbed-type play area. Again, because of the good seal between the cover and the pool walls, the upper surface of the cover remains almost completely dry even when the pool is full. If the cover is to be fitted over an empty pool it may also be provided with one-way valves to enable rain water to drain into the pool. This could be particularly advantageous where a pool is to be left unattended over long periods of time.

Because of its simple construction, the cover shown in the drawings is easy to install in both newly-constructed and existing pools and is considerably cheaper than the more complicated covers previously available. Furthermore, because almost all of the cover drive arrangement is concealed, the cover presents a neat and pleasing appearance and, if operated by means of an electric motor, may be operated entirely automatically from a position remote from the pool.

I claim:

1. A cover for a swimming pool, the cover comprising: an awning of flexible sheet material; guide embers secured to opposite longitudinal edges of said awning; a pair of side rails along opposite longitudinal sides of said pool; channels in the side rails for receiving the guide members, said guide members being slideable longitudinally in said channel, slots extending along the channel on a pool facing side thereof, through which slots the awning extends; means preventing the guide members form exiting the channels through the slots a pair of pull lines secured to a transverse edge of said awning at opposite sides thereof by means of which pull lines said awning can be drawn over said pool with said guide members sliding in said side rails, said pull lines being joined to form a single pull line whereby tension applied to said single pull lines to move said awning is transmitted substantially evenly to the two sides of said awning.

2. The invention set forth in claim 1 further comprising a rotary shaft mounted adjacent one transverse edge of the pool; one transverse edge of said awning being secured to said shaft whereby said shaft is rotatable to roll said awning thereon for storage.

3. The invention set forth in claim 2 further comprising a rotary drum mounted adjacent the same transverse edge of the pool a said rotary shaft, the free end of said single line being secured to said drum; said drum being rotatable to wind said single line thereon to drawn said awning over said pool.

4. The invention set forth in claim 3 further comprising a bidirectional electric motor and clutch means for selectively coupling said rotary drum and said rotary shaft thereto.

5. The invention set forth in claim 2 wherein the uppermost surface of said awning when extended communicates with a drainage channel through which water collecting on said surface can drain away.

6. The invention set forth in claim 5 in which said drainage channel bypasses the interior of the pool.

7. The invention set forth in claim 6 wherein said rotary shaft is mounted in a storage space and is located below the level of the water in the pool; said storage space communicating with the pool interior by means of an opening above said level, whereby water on said uppermost surface tends to flow into said storage space.

8. The invention set forth in claim 7 wherein said storage space is provided with drainage means to permit the outflow of water therefrom.

9. The invention set forth in claim 1 wherein said side rails are of cross-section such as to define two longitudinally extending passages separated by means of a common wall; one of said passages communicating with the interior of said pool by means of a longitudinal slot to provide a keyhole section to receive said guide members; the other said passage serving to guide said single line longitudinally of said pool.

10. The invention set forth in claim 9 wherein said side rails are formed of a plurality of rail sections disposed end to end; said rail sections being aligned and joined by means of a continuous member located in said respective other passages.

11. The invention set forth in claim 9 wherein said rail sections are of extruded aluminum.

12. The invention set forth in claim 9 wherein said pull lines extend longitudinally of said pool within said side rails.

13. The invention set forth in claim 12 wherein said guide members are formed by portions of the pull lines extending along the edges of said awning.

14. The invention set forth in claim 1 further comprising a substantially rigid support member secured to and extending across said transverse edge of said awning.

* * * * *